US009157034B2

(12) United States Patent
Martinez Palou et al.

(10) Patent No.: US 9,157,034 B2
(45) Date of Patent: Oct. 13, 2015

(54) DENITROGENATION OF HYDROCARBONS BY LIQUID-LIQUID EXTRACTION USING IONIC LIQUIDS

(75) Inventors: Rafael Martinez Palou, Mexico City (MX); Diego Javier Guzman Lucero, Mexico City (MX); Jorge Froylan Palomeque Santiago, Mexico City (MX)

(73) Assignee: INSTITUTO MEXICANO DEL PETROLEO, Mexico (MX)

( * ) Notice: Subject to any disclaimer, the term of this patent is extended or adjusted under 35 U.S.C. 154(b) by 399 days.

(21) Appl. No.: 13/559,157

(22) Filed: Jul. 26, 2012

(65) Prior Publication Data

US 2013/0026073 A1 Jan. 31, 2013

(30) Foreign Application Priority Data

Jul. 27, 2011 (MX) ..... MX/a/2011/007922

(51) Int. Cl.

*C10G 21/16* (2006.01)
*C10G 21/20* (2006.01)
*C10G 21/18* (2006.01)

(52) U.S. Cl.

CPC ..... *C10G 21/18* (2013.01); *C10G 2300/104* (2013.01); *C10G 2300/1033* (2013.01); *C10G 2300/1044* (2013.01); *C10G 2300/1048* (2013.01); *C10G 2300/202* (2013.01); *C10G 2400/02* (2013.01); *C10G 2400/04* (2013.01); *C10G 2400/08* (2013.01)

(58) Field of Classification Search

CPC ..... C10G 21/16; C10G 21/20
See application file for complete search history.

(56) References Cited

U.S. PATENT DOCUMENTS

| | | | | |
|---|---|---|---|---|
| 7,053,232 | B2 * | 5/2006 | Moulton | 556/174 |
| 7,553,406 | B2 * | 6/2009 | Wasserscheid et al. | 208/236 |
| 2010/0270211 | A1 * | 10/2010 | Wolny | 208/243 |

FOREIGN PATENT DOCUMENTS

| | | |
|---|---|---|
| WO | 02/34863 | 5/2002 |
| WO | 03/037835 | 5/2003 |

OTHER PUBLICATIONS

L.-L. Xie et al., Selective Extraction of Neutral Nitrogen Compounds Found in Diesel Feed by 1-Butyl-3-Methyl-Imidazolium Chloride, 10 Green Chem. 524-531 (2008).*
N. V. Likhanova et al., Ionic Liquids Screening for Desulfurization of Natural Gasoline by Liquid-Liquid Extraction, 14 Mol. Divers. 777-787 (2010).*
Zhang, S. et al., Extractive Desulfurization and Denitrogenation of Fuels Using Ionic Liquids, Ind. Eng. Chem. Res. 2004, 43, 614-622.
Welton, T., Room-Temperature Ionic Liquids. Solvents for Synthesis and Catalysis, Chem. Rev. 1999, 99. 2071-2083.
Bosmann, A. et al., Deep Desulfurization of Diesel Fuel by Extraction with Ionic Liquids, Chem. Commun., 2001, 2494-2495.
Kim, J. et al., Kinetics of Two Pathways for 4,6-Dimethyldibenzothiophene Hydrodesulfurization over NiMo, CoMo Sulfide, and Nickel Phosphide Catalysts, Energy & Fuels 2005, 19, 353-364.
Esser, J. et al., Deep Desulfurization of Oil Refinery Streams by Extraction with Ionic Liquids, Green Chem., 2004, 6, 316-322.
Xie, L.L. et al., Selective Extraction of Neutral Nitrogen Compounds Found in Diesel Feed by 1-butyl-3-methyl-imidazolium Chloride, Green Chem., 2008, 10, 524-531.
Hernandez-Maldonado, A. et al., Denitrogenation of Transportation Fuels by Zeolites at Ambient Temperature and Pressure, Angew. Chem. Int. Ed. 2004, 43, 1004-1004.
Likhanova, N. et al., Ionic Liquids Screening for Desulfurization of Natural Gasoline by Liquid—Liquid Extraction, Mol Divers (2010) 14:777-787.
Rogers, R. et al., Ionic Liquids as Green Solvents: Progress and Prospects, Aug. 2003.
Rogers, R. et al., Ionic Liquids IIIB: Fundamentals, Progress, Challenges, and Opportunities, Mar. 2005.
Visser A. et al., Room Temperature Ionic Liquids as Replacements for Traditional Organic Solvents and their Applications Towards "Green Chemistry" in Separation Processes, R.D. Rogers et al. (eds.), Green Industrial Applications of Ionic Liquids, 2003, 131-156.
Rogers, R. et al., Ionic Liquids: Industrial Applications to Green Chemistry, Aug. 2002.
Zhao, H. et al., Applications of Ionic Liquids in Organic Synthesis, Aldrichimica ACTA, vol. 35, No. 3, 2002.

* cited by examiner

*Primary Examiner* — Randy Boyer
(74) *Attorney, Agent, or Firm* — Dickinson Wright

(57) ABSTRACT

This invention is related to the use of ionic liquids of general formula $C^+A^-$, where $C^+$ represents a cation of organic or inorganic type, specifically of the type imidazolium, pyridinium or ammonium salts, while the anion $A^-$ are derivatives which are halides, salts of iron (III), aluminum salts (III), acetate and benzoate, though not exclusively. These agents act as ionic liquid extractants of nitrogenous compounds present in hydrocarbon streams through a process of liquid-liquid extraction thereby can be reduced by more than 60% the content of these contaminants in hydrocarbon streams.

5 Claims, No Drawings

DENITROGENATION OF HYDROCARBONS BY LIQUID-LIQUID EXTRACTION USING IONIC LIQUIDS

CROSS-REFERENCE TO RELATED APPLICATION

This application claims the benefit under 35 U.S.C. §119 of Mexican Patent Application No. MX/a/2011/007922, filed Jul. 27, 2011, which is hereby incorporated by reference in its entirety.

FIELD OF THE INVENTION

The present invention is related to the synthesis of compounds known as ionic liquids with the property of removing efficiently pollutants such as nitrogen compounds from mixtures of hydrocarbons, especially those contained in streams used for ultra low Sulphur Diesel.

Certain ionic liquids immiscible in oils have the ability to extract considerable amounts of nitrogenous compounds that are contaminating the streams of hydrocarbons, so it is possible to remove these compounds of hydrocarbons through a liquid-liquid extraction process at ambient pressure and temperatures between 25-60° C. This extraction process can be used as a pre-treatment process of hydrodesulfurization (HDS) in order to increase the life time of the catalysts and improve the efficiency of this process in softer conditions of operation.

Specifically, the invention relates to the application for the removal of nitrogen compounds, by means of compounds of the ionic liquids type with general formula $C^+A^-$, where $C^+$ represents an organic cation of the type: alkyl-pyridinium, dialkyl imidazolium and tetra-alkylammonium; While $A^-$ are halide anions or salts of some transition metals, especially iron and aluminum and other organic anions.

BACKGROUND OF THE INVENTION

In Mexico, according to NOM-086-SENER-SEMARNAT SCFI-2005, the content of total sulphur in Diesel should be reduced up to 15 ppm in weight, this implies the production of ultra low sulphur diesel, for which PEMEX has carried out significant modifications in the HDS process and all of the catalysts used to produce Diesel Ultra low sulphur (DUBA) are currently imported.

The elimination of sulphur and nitrogen compounds from fossil fuels is a priority in recent years. Sulfur and nitrogen compounds present in hydrocarbons when subjected to the combustion process, gas emissions like SOx and NOx are produced which are highly toxic and are the main promoters of acid rain.

The alternative used in the oil industry to remove these contaminants is the process of hydrodesulfurization (HDS), consisting in a reduction reaction at high pressures and temperatures of the sulfur and nitrogen components in the presence of hydrogen using catalysts. This process is extremely expensive, and although aliphatic sulfur and nitrogen compounds are reduced, it is inefficient in the reduction of aromatic compounds.

Different non-conventional alternatives to remove sulphur and nitrogen compounds have been studied. An alternative is the use of ionic liquids for the selective removal of these compounds through a process of liquid-liquid extraction.

Mexican heavy crudes are characterized by a high content of nitrogen compounds, which in addition to generate toxic gases, they are important inhibitors of the HDS reaction, so the prior removal of nitrogenous compounds contributes to achieve the sulphur levels required in less severe operating conditions and increase the life time of the catalysts.

In some countries new technological lines for the solution of this problem have been developed such as the use of absorbent materials such as the one described in U.S. Pat. No. 7,935,248, U.S. Pat. No. 7,094,333 and the references Denitrogenation of Transportation Fuels by Zeolites at Ambient Temperature and Pressure, Hernandez-Maldonado et al., Angewandte Chemie, 2004, pp. 1004-1006; Ultra-deep desulfurization and denitrogenation of diesel fuel by selective adsorption over three different adsorbents: A study on adsorptive selectivity and mechanism, Kim et al., Elsevier B.V., 2005, pp. 74-83; or through a process of oxidative denitrogenation (U.S. Pat. No. 7,666,297, U.S. Pat. No. 7,276,152).

Ionic liquids have been intensively studied in recent years due to its physico-chemical properties, such as: very low vapor pressure, they are not flammable, non-corrosive and low toxicity, they are excellent substitutes for common organic solvents (Wasserscheid, P.) Keim, W. (Eds.) Ionic Liquids in Synthesis, Wiley-VCH, Wenheim, 2004; Welton, T. Chem. Rev. 1999, 99, 2071-2084; Zhao, H.; Malhotra, S. V. Aldrichimica Acta 2002, 35, 75-83), which has promoted the rapid development of a wide variety of industrial applications for these compounds (Rogers, R. D.); Seddon, K. R. (Eds.) Ionic Liquids: Industrial Applications of Green Chemistry. ACS, Boston, 2002; Rogers, R. D.; Seddon, K. R. (Eds.) Ionic Liquids as Green Solvent: Progress and Prospects. (ACS Symposium Series), Boston, 2003; Rogers, R. D.; Seddon, K. R. (Eds.) Ionic Liquids IIIB: Fundamentals, Progress, Challenges and Opportunities: Transformations and Processes (ACS Symposium Series), Boston, 2005; Roger, R. D.; Seddon, K. R.; Volkov, S (Eds.). Green Industrial Applications of Ionic Liquids. (NATO Science Series), Kluwer Academic Publishers, Dordrecht, Netherlands, 2002.).

Ionic liquids are known for more than 30 years. Its heyday in different industrial applications started approximately 10 years ago (Rogers, R. D.;) Seddon, K. R. (Eds.), Ionic Liquids Industrial Applications of Green Chemistry, ACS, Boston, 2002). They are applied as solvents, as catalysts in alkylation, polymerization and Diels-Alder reactions, in electrochemical processes and as solvents for the extraction of $CO_2$, sulphur and aromatic compounds from mixtures of hydrocarbons, among others. One of the first publications that mention the use of ionic liquids for removal of mercaptans in oils is WO 0234863, dated 2002 May 2. The patented method, is based on the use of sodium hydroxide in combination with Ionic liquids, to improve the conversion of mercaptans into mercaptides. Peter Wasserscheid and collaborators, published from 2001 to 2005 several patents and articles on the topic of the use of ionic liquids, to the process of desulphurization in hydrocarbons (Chem. Comun. 2001, 2494, Green Chem. 2004 6, 316); WO 03037835, date of publication 2003 May 8; US 20050010076 A1, date of publication 2005 Jan. 13). In this work, the authors used liquids of the type $C^+A^-$ where $C^+$ is 1,3-dialkylimidazolium or tetra-alkylammonium, and $A^-$ are tetra-chloroaluminates or methanesulfonates. Through a process of repeated extractions (up to 8 successive extractions), high removal of sulfur compounds from gasoline model efficiencies were achieved.

U.S. Pat. No. 7,749,377, 2010, treats acidic ionic liquids containing the anion $HSO_4^-$ for the selective removal of nitrogen compounds. However, no other patent has described the use of ionic liquids as proposed in the present invention for this application. Some authors have described this application in scientific papers using loads models, for example Eβer and collaborators found a good extraction efficiency of nitrogen compounds, using the Ionic [BMIM][$OcSO_4$], for a sample model containing 1000 ppm of nitrogen as n-dodecane indole (Eβer, J., et. al.) Green Chem. 2004, 6, 316-322). Meanwhile Zhang and colleagues assessed the capacity of removal of nitrogen compounds with the Ionic Liquid [BMIM] $BF_4$ using a model gasoline. Zhang, S. G., et al. Ind. Eng. Chem. Res. 2004, 43, 614-622. In the article by Li-Li Xie and collaborators (Green Chem., 2008, 10, 524-531) describes the selective extraction of neutral nitrogen compounds in diesel such as 1-butyl-3-methyl-imidazolium chloride using a model gasoline.

SUMMARY OF THE INVENTION

The present invention is directed to a process for denitrogenation of hydrocarbons and particularly petroleum or petroleum products such as diesel. The process of the invention removes the nitrogen compounds from the hydrocarbon by liquid to liquid contact with an ionic liquid.

In the process of the invention, the ionic liquid is contacted with the petroleum liquid at an ionic liquid to hydrocarbon ratio of about 1:1 to about 1:50, and preferably about 1:10 by volume. The denitrogenation of the petroleum is carried out at a temperature of about 25-75° C., and preferably about 60° C.

The ionic liquid has the formula $C+A^-$ where $C^+$ is an organic or inorganic cation and $A^-$ is an anion. The cation $C^+$ is a 5 or 6 membered heterocyclic ring having 1 or 2 nitrogen atoms or a quaternary ammonium type cation. The anion can be an organic or inorganic cation such as a halogen, transition metal, acetate or benzoate. The halogen can be a chloride, bromide, fluoride or iodide.

The features of the invention are basically attained by providing a process for denitrogenation of hydrocarbons by means of liquid-liquid extraction, which employs as extractant phase of an ionic liquid characterized by a nitrogen heterocyclic cation from 5 to 6 members and 1 or 2 atoms of nitrogen, selected from the group consisting of the compounds of formula (1) and (2), or a quaternary ammonium type of formula (3), and an organic or inorganic anion selected from the group consisting of halogens, transition metal salts, acetates and benzoates, where the radicals $R_1$, $R_2$, $R_3$ and $R_4$ may be hydrogen atoms or an aliphatic chain or branched alkyl, alkoxy or functionalized or substituted alkyl containing from 1 to 10 carbon atoms.

1

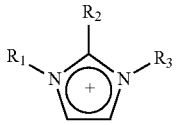

2

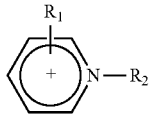

3

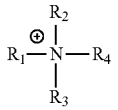

DETAILED DESCRIPTION OF THE INVENTION

The present invention relates to implementing certain ionic liquids with the ability to remove the pollutant nitrogen compounds from currents of hydrocarbons obtained in the petroleum refining process, especially those used for the production of Diesel. The removal of nitrogen compounds is carried out through a liquid-liquid (ionic liquid-hydrocarbon) extraction step, due to the stronger affinity of the nitrogenous compounds by the phase of ionic liquid on the phase formed by hydrocarbons. A vigorous stirring of the two phases, followed by a time of rest for the separation of phases, results in the transfer of nitrogenous compounds to the Ionic Liquid phase, and the total content of nitrogen is reduced considerably in the hydrocarbon phase.

The ionic liquids used in this invention, have the general formula $C^+A^-$, where $C^+$ represents a cation of organic type, specifically of the types: alkyl-pyridinium, dialkyl imidazolium and tetraalkylammonium; While the anion $A^-$ are halides or salts of transition metals, especially iron and aluminum and other anions of organic type.

Synthesis of ionic liquids used in this invention was carried out through non-conventional heating with microwave and ultrasound. These methods are described in the literature by offering significant advantages such as the elimination of conventional solvents during the stage of alkylation, getting products with greater purity; the increase in the yield of the reaction, the reduction of reaction time and, consequently, the cost of obtaining the ionic liquids.

Additional benefits of this invention are the optimization of quantities of ionic liquid used in the process of extraction denitrogenation of fuels, to allow the use of smaller quantities of ionic liquid in concerning the hydrocarbon weight/weight ratio, with ratios of 1:10, 1:20 and 1:50.

Another added advantage of this invention is the increase in the time of life of the catalysts used in the process, due to the removal of these contaminants to prevent catalyst poisoning and favor that the sulfur compounds removal process is more efficient and smoother operation conditions.

Ionic Liquids Employed

The ionic liquids utilized in this invention were derivated from cation of the type:

Imidazolium:

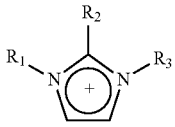

where $R_1$, $R_2$ and $R_3$ are aliphatic or branched chain alkyl, alkoxy or functionalized alkyl groups, containing from 1 to 10 carbon atoms, and preferably 2 to 8 carbon atoms. In one embodiment, $R_1$ is a hydrogen or a methyl group. The groups $R_1$ and $R_3$ can be the same (symmetric ionic liquids) or different (asymmetric ionic liquids).

Pyridinium:

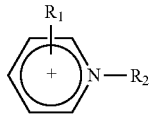

where $R_1$ is a hydrogen atom or an alkyl substituent and $R_2$ is a linear or branched aliphatic chain containing from 1 to 10 atoms of carbon, preferably in the range of 2 to 8 carbon atoms.

Ammonium Salts:

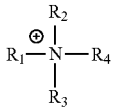

Where the substituents $R_1$, $R_2$, $R_3$ and $R_4$ are linear or branched aliphatic chain containing from 1 to 10 atoms of carbon, preferably in the range of 2 to 8 carbon atoms and may contain heteroatoms inserted into the chain and functional groups at the ends of them.

In both cases the halide anion can be halogens (chlorine or bromine), salts of some transition metals, especially iron and aluminum and other anions in organic type as described in the following examples.

Synthesis of Ionic Liquids

The synthesis of ionic liquids is performed in two stages, based on the method of alkylation and subsequently obtained different anions by metathesis of halogenated anion or ionic exchange with salts or acids containing the desired anion (refs: Likhanova et al.) MOL. 2010 Div., 14, 777-789). The synthesis can be carried out by conventional heating or the use of microwaves.

Some examples of synthesis are described, although the scope of the present invention is not limited to them.

Example 1

Synthesis of 1-butyl-3-methylimidazolium chloride (1) and 1-butyl-3-methylimidazolium tetrachloroferrate (2)

1.64 g (20 mmol) of 1-methylimidazole and 5.55 g (60 mmol) of 1-chlorobutane are mixed in a reaction container. The mixture is remained at reflux and agitation for 48 hrs or is irradiated under microwave (1 00 W) for 50-60 minutes. After the reaction, two phases were produced and the upper layer was decanted. The residue was washed with ethyl acetate (3×20 ml). The solvent was evaporated under vacuum. ~colorless viscous liquid (70% performance by conventional method) and 80% with the use of microwaves was obtained. At this stage of synthesis the compound (1) is obtained.

(1)

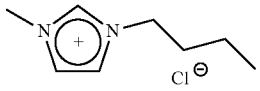

In a reactor of glass provided with a system of agitation 0.87 g (5 mmol) of 1-butyl-3-methylimidazolium chloride, retrieved from stage 1, and 1.22 g (7.5 mmol) iron chloride (III) anhydrous, were added and the mixture was stirred for 20 min in an inert atmosphere at room temperature, obtaining a reddish liquid.

Spectroscopic characterization (1H and 13 C NMR) studies show that the compound has the following structure:

(2)

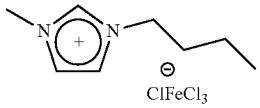

Example 2

Synthesis of 1-butyl-2,3-dimethylimidazolium bromide (3) and bromotrichloroferrate 1-butyl-2,3-dimethylimidazolium (4)

1-butyl-2,3-dimethylimidazolium bromide was obtained (88% of performance by conventional method and 90% in microwave) with the same procedure as described in Example 1 (paragraph 1), using 20 mmol of 1,2-dimethylimidazole and butyl bromide. At this stage of synthesis the compound (3) is obtained.

(3)

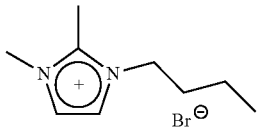

In a glass reactor provided with a system of agitation, 0.94 g (5 mmol) of 1-butyl-2-3-dimethylimidazolium chloride and 1.22 g (7.5 mmol) iron chloride (III) anhydrous were added, and the mixture was stirred for 20 minutes in an inert atmosphere at room temperature, obtaining a reddish liquid. Compound (4) is obtained at this stage of synthesis.

(4)

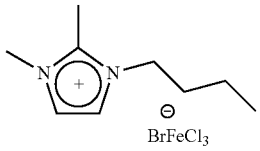

Example 3

Synthesis of N-octylpyridinium chloride (5) and octylpyridinium tetrachloroferrate (6)

The N-octylpyridinium chloride (68% of performance by conventional method and 79% in microwave) was obtained with the same procedure as described in example 1 (paragraph 1), using 20 mmol of pyridine and 25 mmol of 1-chloro-octane. At this stage of synthesis the compound (5) is obtained.

(5)

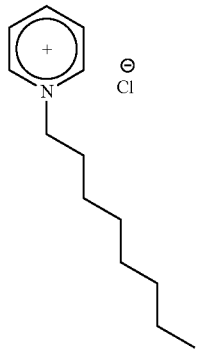

In a reactor of glass provided with a system of agitation 1.14 g (5 mmol) of N-octylpyridinium chloride and 1.22 g (7.5 mmol) of iron chloride (III) anhydrous, were added and the mixture was stirred for 20 minutes in an inert atmosphere at room temperature, obtaining a reddish liquid. At this stage of synthesis the compound (6) is obtained.

The spectroscopic characterization ($^{1}H$, $^{13}C$ de RMN) showed that the compound present the following structure:

(6)

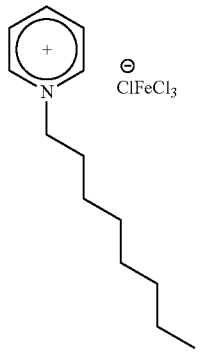

Example 4

Synthesis of 1-butyl-3-methylimidazolium acetate (7) and 1-butyl-3-methylimidazolium benzoate (8)

The synthesis was carried out by ion interchange, starting from 7.5 mmol of compound (1) with equivalent amount of silver benzoate or acetate, obtaining the compounds (7) and (8). The products were purified by consecutive washings with water (2×30 ml), acetonitrile (2×30 ml) and Hexane (2×30 ml), dried under vacuum, and was confirmed the chemical structure by NMR.

(7)

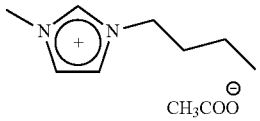

-continued (8)

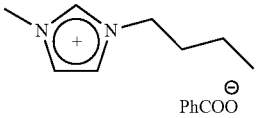

Example 5

Synthesis of N-(ethoxymethyl)-N,N'-dimethylethaneammonium chloride (9) and N-(ethoxymethyl)-N,N'-dimethylethaneammonium acetate (10)

Compound (9) was obtained by the reaction of dimethylethylamine (6.8 mmol) and chloromethylethylether (8.2 mmol) in chloroform as solvent at 0° C. The reaction mixture was kept under stirring from 18 hours. After the lower phase was separated and washed with ethyl ether (2×30 ml) and the product was dried under vacuum for 8 hours. The chemical structure was confirmed by NMR.

Compound (10) was obtained by ion interchange at 60° C. for 24 hours between Compound (9) and equimolar amount of silver acetate. The product was purified through consecutive washings with water (2×30 ml), acetonitrile (2×30 ml) and hexane (2×30 ml).

(9)

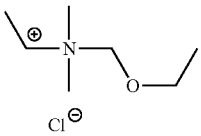

(10)

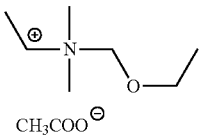

Performance Test of Ionic Liquids in the Denitrogenation of Hydrocarbons

Evaluation was made from a real sample of diesel with the following composition:

TABLE 1

Physicochemical characterization of diesel

| Analytical test (units) | Quantity |
|---|---|
| atmospheric distillation ($T_{Start}$-$T_{End}$ ° C.) | 172.7-376.7 |
| Specific gravity 20/4° C. | 0.8652 |
| Cetane index | 49.3 |
| Kinematic viscosity ($mm^2/s$, 40° C.) | 5.6 |
| Aniline temperature (° C.) | 72.8 |
| API Gravity (°) | 81.80 |
| Saybolt Color | >+30 |
| Total Sulfur (ppm) | 13000 |
| Total nitrogen (ppm) | 466 |
| Basic nitrogen (ppm) | 111 |

TABLE 1-continued

| Physicochemical characterization of diesel | |
|---|---|
| Analytical test (units) | Quantity |
| Aromatic distribution (% peso): | |
| Monoaromatics | 18.4 |
| Diaromatics | 12.7 |
| Polyaromatics | 2.6 |
| Total aromatics | 33.7 |

The extractions test of nitrogen compounds was made by placing in contact 1 part of ionic liquid respect to 10 parts of diesel (w/w) at 60° C. and atmospheric pressure with stirring at 600 rpm for 30 minutes. The nitrogen content was determined by the method ASTM D 4629-02.

Table 2 shows the obtained results.

TABLE 2

| Removal of nitrogen compounds in hydrocarbons (HC) by ionic liquid (IL) extraction. | |
|---|---|
| Ionic Liquid | Percentage of nitrogen removed (%) |
| 1-butyl-3-methylimidazolium chloride (1) | 70 |
| 1-butyl-3-methylimidazolium tetrachloroferrate (2) | 95 |
| 1-butyl-2,3-dimethyl-imidazolium bromide (3) | 53 |
| 1-butyl-2,3-dimethylimidazolium bromotrichloroferrate (4) | 87 |
| Octylpyridinium chloride (5) | 66 |
| N-Octylpyridinium tetrachloroferrate (6) | 87 |
| 1-butyl-3-methylimidazolium acetate (7) | 69 |

TABLE 2-continued

| Removal of nitrogen compounds in hydrocarbons (HC) by ionic liquid (IL) extraction. | |
|---|---|
| Ionic Liquid | Percentage of nitrogen removed (%) |
| 1-butyl-3-methylimidazolium benzoate (8) | 59 |
| N-(Ethoxylmethyl)-N,N-dimethylethaneammonium chloride (9) | 78 |
| N-(Ethoxymethyl)-N,N-dimethylethaneammonium acetate (10) | 69 |

As shown in Table 2, ionic liquid exhibit a good efficiency for removal of nitrogen compounds. Ionic liquids containing halogens as anion are of particular interest because they can be obtained in a single reaction step and have a greater chemical stability.

What is claimed is:

1. A process for denitrogenation of hydrocarbons by means of liquid-liquid extraction, comprising the step of contacting the hydrocarbon liquid with an ionic liquid and extracting nitrogen compounds from the hydrocarbon, wherein the ionic liquid is selected from the group consisting of N-(ethoxymethyl)N,N'-dimethylethane ammonium chloride and N-(ethoxymethyl-N,N'-dimethylethane ammonium acetate.

2. The process for denitrogenation of hydrocarbons in accordance with claim 1, wherein the ionic liquid to hydrocarbon ratio is in the range 1:1 to 1:50.

3. The process for denitrogenation of hydrocarbons in accordance with claim 2, wherein said denitrogenation is carried out at a temperature in the range 25-70° C.

4. The process of claim 2, wherein said ionic liquid to hydrocarbon ratio is about 1:10.

5. The process of claim 3, wherein said temperature is about 60° C.

* * * * *